US008858817B2

(12) United States Patent
Jiang et al.

(10) Patent No.: US 8,858,817 B2
(45) Date of Patent: Oct. 14, 2014

(54) POLISHING APPARATUS AND EXCEPTION HANDLING METHOD THEREOF

(75) Inventors: Li Jiang, Shanghai (CN); Mingqi Li, Shanghai (CN)

(73) Assignee: Semiconductor Manufacturing International (Beijing) Corporation, Beijing (CN)

( * ) Notice: Subject to any disclaimer, the term of this patent is extended or adjusted under 35 U.S.C. 154(b) by 348 days.

(21) Appl. No.: 13/176,674

(22) Filed: Jul. 5, 2011

(65) Prior Publication Data

US 2012/0142254 A1 Jun. 7, 2012

(30) Foreign Application Priority Data

Dec. 3, 2010 (CN) ..... 2010 1 0573122

(51) Int. Cl.

| | |
|---|---|
| ***C03C 15/00*** | (2006.01) |
| ***B24B 37/34*** | (2012.01) |
| ***B24B 37/005*** | (2012.01) |
| ***B24B 55/00*** | (2006.01) |

(52) U.S. Cl.

CPC ..... *B24B 37/005* (2013.01); *B24B 37/34* (2013.01); *B24B 55/00* (2013.01)

USPC ..... 216/86; 438/692

(58) Field of Classification Search

None

See application file for complete search history.

(56) References Cited

U.S. PATENT DOCUMENTS

| | | | | |
|---|---|---|---|---|
| 6,409,576 | B1 * | 6/2002 | Oguri et al. | 451/6 |
| 6,634,930 | B1 * | 10/2003 | Chen et al. | 451/41 |
| 2002/0034876 | A1 * | 3/2002 | Han | 438/692 |
| 2002/0058363 | A1 * | 5/2002 | Ohashi et al. | 438/151 |
| 2005/0112894 | A1 | 5/2005 | Park et al. | |
| 2008/0125341 | A1 * | 5/2008 | Misra et al. | 510/175 |
| 2009/0318062 | A1 * | 12/2009 | Chiu et al. | 451/8 |

FOREIGN PATENT DOCUMENTS

CN 101197248 A 6/2008

OTHER PUBLICATIONS

Steigerwald et al, Chemical Mechanical Planarization of Microelectronic Materials, 2004, Wiley-VCH, p. 36-47.*

* cited by examiner

*Primary Examiner* — Binh X Tran
*Assistant Examiner* — David Cathey, Jr.
(74) *Attorney, Agent, or Firm* — Anova Law Group, PLLC

(57) ABSTRACT

A polishing apparatus and exception handling method thereof is disclosed, the exception handling method of polishing apparatus includes: sending an alarm signal when an alarm is generated because of an exception during polishing; and processing a wafer in the polishing apparatus with organic acid solution according to the received alarm signal. The method and apparatus prevent the metal material from corrosion which causes device failure, when there is an alarm generated because of an exception which stops the apparatus during polishing.

12 Claims, 2 Drawing Sheets

POLISHING APPARATUS AND EXCEPTION HANDLING METHOD THEREOF

CROSS REFERENCE TO RELATED APPLICATIONS

The present application claims the priority of Chinese Patent Application No. 201010573122.1, entitled "Polishing Apparatus and Exception Handling Method Thereof", and filed on Dec. 3, 2010, the entire disclosure of which is incorporated herein by reference.

BACKGROUND OF THE INVENTION

1. Field of the Invention

The present invention relates to the field of semiconductor manufacturing, and particularly relates to a polishing apparatus and exception handling method thereof.

2. Description of Prior Art

With the continuous development of the semiconductor manufacturing process, processes have entered nanometer era. The manufacturing of VLSI requires tens of millions of transistors and interconnects to be formed within an area of several square centimeters; and the multilayer metal technology makes the integration of millions of transistors and interconnects within a single integrated circuit possible. The chemical mechanical polishing (CMP) process is a major process of planarization in the multilayer metal technology.

CMP process is introduced to the IC manufacturing industry in 1984 by IBM, and is firstly used to planarize inter metal dielectric (IMD) in back channel process. The CMP process is then used to planarize tungsten, and then shallow trench isolation (STI) and copper. CMP has become one of the most important and fastest developed technologies in IC manufacturing industry.

For the mechanism of CMP, it is described that: a surface layer which is relatively easy to remove is formed by reaction of the surface material of a wafer and polishing liquid, and the surface layer is then mechanically scraped off by polishing pressure and by relative motion between polishing pad and the wafer. Specifically, during the CMP of metal material, polishing liquid is in contact with the surface of the metal material, and metal oxide is generated which is then mechanically scraped off to achieve the effect of polishing. However, when surface of the metal material (especially for copper and aluminum) is exposed to the deionized water or grinding liquid for a long time, the metal material tend to be corroded which causes device failure.

Currently, CMP process is fully controlled by computer. During a CMP process, if there is an abnormal situation, such as pressure or rotation speed exception, the polishing equipment will automatically stop working and send alarm, then waits for device engineers. During the waiting for device engineers, the wafer that is unfinished in the CMP process (including wafers in a grinding stage or in a cleaning stage after grinding) is left in the grinding liquid or cleaning liquid (normally deionized water), which will cause the surface of the metal material be corroded thus affecting the quality of wafers.

A CMP technology is disclosed in US Patent Publication No. US20050112894A1, which includes CMP slurry for forming aluminum film, CMP method using the slurry and method for forming aluminum wiring using the CMP method.

SUMMARY OF THE INVENTION

The present invention is to solve the problem that when there is an alarm generated because of an exception during polishing, the wafer is left in the grinding liquid or cleaning liquid for a long time, and the surface of metal material is corroded which causes device failure.

To solve the above problem, there is provided a polishing apparatus in the present invention, which includes: a grinding device and a cleaning device, wherein the polishing apparatus further includes an alarm unit and a processing unit; the alarm unit sending an alarm signal to the processing unit when an alarm is generated because of an exception during polishing; the processing unit processing a wafer in the polishing apparatus with organic acid solution according to the received alarm signal.

Optionally, the alarm is generated by the grinding device, the alarm signal sent by the alarm unit being a first alarm signal; and the processing unit processing a wafer in the polishing apparatus with organic acid solution includes: processing the wafer in the grinding device with organic acid solution.

Optionally, the alarm is generated by the cleaning device, the alarm signal sent by the alarm unit being a second alarm signal; and the processing unit processing a wafer in the polishing apparatus with organic acid solution includes: processing the wafer in the grinding device and the cleaning device with organic acid solution.

Optionally, the polishing apparatus further includes a head clean load/unload, wherein the processing unit processing a wafer in the polishing apparatus with organic acid solution includes: processing the wafer in the head clean load/unload with organic acid solution.

Optionally, the processing unit processing the wafer in the grinding device with organic acid solution includes: placing the wafer that has been grinded by the grinding device into an isolation tank filled with organic acid solution.

To solve the above problem, there is also provided an exception handling method of polishing apparatus in the present invention, which includes:

sending an alarm signal when an alarm is generated because of an exception during polishing; and processing a wafer in the polishing apparatus with organic acid solution according to the received alarm signal.

Optionally, the alarm is generated by a grinding device of the polishing apparatus, the alarm signal being a first alarm signal; and processing a wafer in the polishing apparatus with organic acid solution includes: processing the wafer in the grinding device of the polishing apparatus with organic acid solution.

Optionally, the alarm is generated by a cleaning device of the polishing apparatus, the alarm signal being a second alarm signal; and processing a wafer in the polishing apparatus with organic acid solution includes: processing the wafer in a grinding device and the cleaning device of the polishing apparatus with organic acid solution.

Optionally, processing a wafer in the polishing apparatus with organic acid solution includes: processing the wafer in a head clean load/unload of the polishing apparatus with organic acid solution.

Optionally, processing the wafer in a grinding device of the polishing apparatus with organic acid solution includes: placing the wafer that has been grinded by the grinding device into an isolation tank filled with organic acid solution.

Optionally, processing a wafer in the polishing apparatus with organic acid solution includes: spraying organic acid solution to the wafer.

Optionally, organic acid solution is sprayed to the wafer continuously during a first processing time period after the alarm signal is received.

Optionally, the first processing time period is 1 to 5 minutes.

Optionally, the organic acid solution sprayed to the wafer has a flow rate larger than 1000 ml/min.

Optionally, organic acid solution is sprayed to the wafer periodically during a second processing time period which is after the first processing time period and before the alarm is discharged.

Optionally, for each time when organic acid solution is sprayed to the wafer, time for spraying organic acid solution plus interval time is equal to the first processing time period, and interval time is 20%~90% of the first processing time period.

Optionally, the organic acid solution sprayed to the wafer has a flow rate larger than 500 ml/min.

Optionally, the organic acid is oxalic acid, malonic acid, succinic acid, maleic acid, phthalic acid or amino acid.

Optionally, the organic acid solution has a concentration of 0.01~10 wt %.

In comparison with the conventional technologies, the present invention has the following advantages:

Where there is an alarm generated because of an exception during polishing of a wafer in a polishing apparatus, the alarm unit sends an alarm signal to the processing unit, and the processing unit processes the wafer in the polishing apparatus with organic acid solution, which prevents the surface of the wafer from contacting grinding liquid or cleaning liquid for a long time, avoids the corrosion of the surface and improves the quality of wafers.

DETAILED DESCRIPTION OF THE EMBODIMENTS

Figure 1:
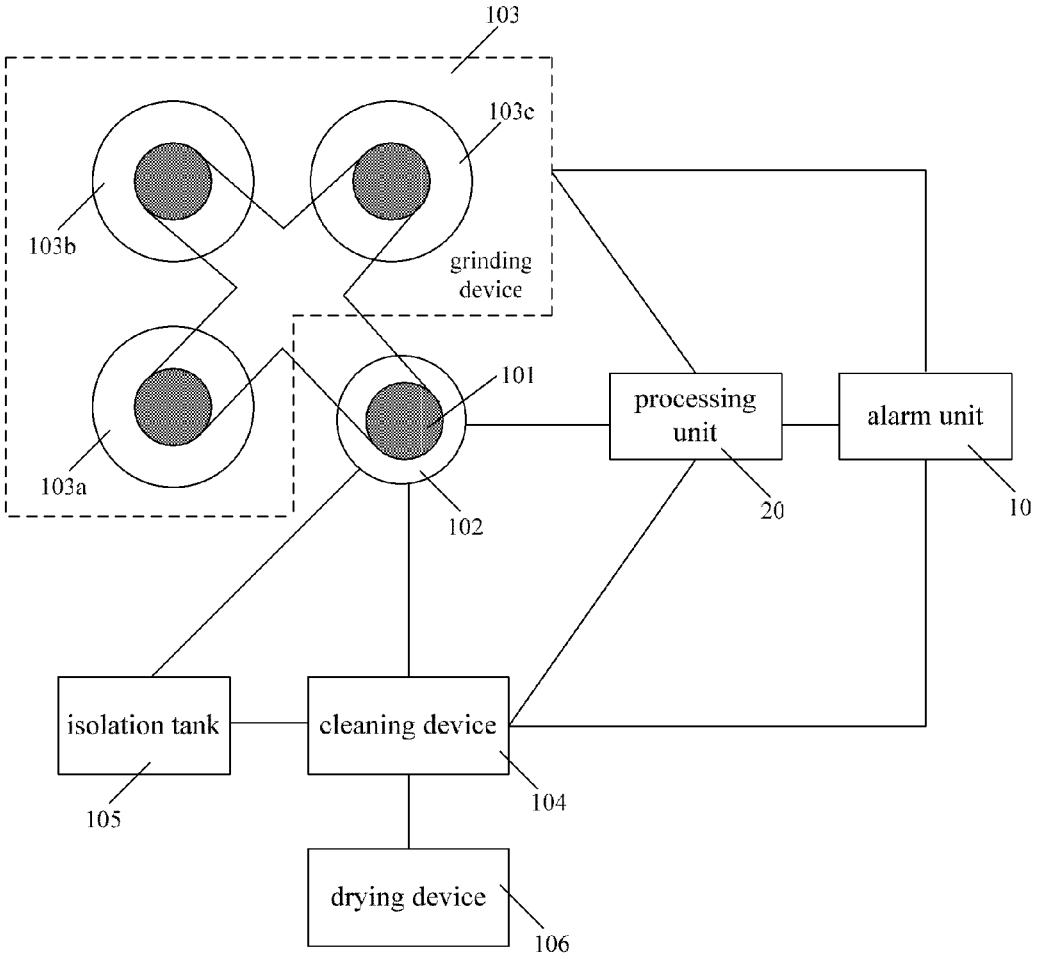
FIG. 1 is a schematic view of a polishing apparatus in an embodiment of the present invention.

Hereunder, the present invention will be described in detail with reference to embodiments, in conjunction with the accompanying drawings.

Embodiments to which the present invention is applied are described in detail below. However, the invention is not restricted to the embodiments described below.

A conventional polishing apparatus generally includes a grinding device; a cleaning device and a head clean load/unload (HCLU). Normally, the polishing apparatus also includes a transmission, such as conveyor belt or mechanical arm, which is used to transfer wafers among devices. The polishing process generally includes two steps, which are grinding and cleaning; the grinding step is performed by the grinding device and the cleaning step is performed by the cleaning device. The grinding device is mainly composed of a platen, a grinding head (polishing head), a grinding pad disposed on the platen, and a grinding liquid nozzle. In the grinding step, the HCLU delivers the wafer to be polished to the grinding device for grinding. Specifically, take polishing metal material for example, the grinding liquid nozzle sprays grinding liquid that contains grinding agent to the grinding pad. The grinding head fixes the wafer by vacuum suction and places the wafer into the grinding liquid on the grinding pad. The metal surface of the wafer is oxidized to metal oxide by the grinding agent. The grinding head imposes downward pressure; the platen rotates with the grinding pad (the grinding head can rotate in an opposite direction); the metal oxide on the surface of the wafer is then mechanically scraped off by pressure and by relative motion between grinding pad and the wafer. The wafer which is grinded by the grinding device is then delivered by the HCLU to the cleaning device for cleaning. The cleaning device (such as cleaning tank or cleaning brush) usually washes the wafer by deionized water to remove small scratches, particles (grinding agent particles, particles resulting from grinding, etc.) and other objects of chemical contamination on the surface of the wafer.

As discussed in the background, during work of a conventional polishing apparatus, computers are used to monitor the working status (the computers can be a part of the polishing apparatus). When there is an abnormal situation, such as an exception of the pressure or rotation speed of the grinding head, the polishing apparatus will stop, and send alarm and then wait for engineers to fix the problem. The alarm may be generated by grinding device or may be generated by the cleaning device. If the alarm is generated by the grinding device, the grinding of the wafer on the platen will stop, the wafer will be left in the grinding liquid before the alarm is discharged (before the engineer is to fix the problem), and the wafer in the cleaning device will be cleaned and then delivered back to a wafer box. If the alarm is generated by the cleaning device, the cleaning of the wafer in the cleaning device will stop, the wafer will be left in the cleaning liquid (normally deionized water) before the alarm is discharged, and the wafer in the grinding device will be grinded and then placed into an isolation tank filled with deionized water by the HCLU.

During the waiting for the engineers, the wafer in the grinding device and the wafer in the cleaning device are all left in the grinding liquid or cleaning liquid (normally deionized water). The inventor found out that because of the polishing to the metal material of the wafer, barrier layer (which is polished with the metal material) of the wafer is also exposed. The barrier layer is normally made of Ta or TaN, which has different characteristics from the metal material (normally copper or aluminum). When the metal material (especially for copper and aluminum) is in an electrolyte solution for a long time, such as the grinding liquid or cleaning liquid, it tends to be corroded by galvanic corrosion. Galvanic corrosion is an electrochemical process in which one metal corrodes preferentially to another when both metals are in electrical contact and immersed in an electrolyte. The same galvanic reaction is exploited in primary batteries to generate a voltage.

To prevent the corrosion of the surface of the metal material as discussed above, there is provided a polishing apparatus in the present invention.

The polishing apparatus is described in detail with reference to embodiments, in conjunction with the accompanying drawings. FIG. 1 is a schematic view of a polishing apparatus in an embodiment of the present invention. In FIG. 1, the polishing apparatus includes a grinding device 103, a cleaning device 104, a head clean load/unload (HCLU) 102 and a drying device 106. The polishing apparatus also includes a transmission (such as a conveyor belt or a mechanical arm) which is used to deliver wafers among devices; the transmission will not be discussed in detail in this embodiment. In practice, on one hand, wafers are placed on a plurality of platens for grinding to accelerate polishing speed; on the other hand, different platens may have grinding pads with different materials for grinding different materials of wafers, certain wafers need to be grinded on different platens. As shown in FIG. 1, the grinding device 103 includes three platens, which are platen 103*a*, platen 103*b* and platen 103*c*. In practice, wafer 101 is loaded into one platen of the grinding device 103 by the head clean load/unload 102; after being grinded, the wafer 101 is delivered by the transmission and the head clean load/unload 102 to the cleaning device 104 for cleaning. After being cleaned, the wafer 101 is delivered to the drying device 106 for a drying treatment and then back to the wafer box. In this embodiment, the grinding is performed to the metal material (such as copper and aluminum) of the wafer.

The polishing apparatus further includes: an alarm unit 10 and a processing unit 20. The alarm unit 10 sends an alarm signal to the processing unit 20 when an alarm is generated because of an exception during polishing; and the processing unit 20 processes a wafer in the polishing apparatus with organic acid solution according to the received alarm signal. In some embodiments, the alarm unit 10 and the processing unit 20 can be a software control system of the polishing apparatus, which control hardware devices; the alarm unit 10 and the processing unit 20 can be hardware devices under the control of a software control system of the polishing apparatus.

There are alarm devices including exception monitoring devices and warning devices placed in the grinding device 103 and the cleaning device 104. The exception monitoring devices are used to monitor the working status of the polishing apparatus, for example, an exception monitoring device performs real-time detection of the pressure and rotation speed of the grinding head and sends back detected data. When an abnormal situation is detected in the polishing apparatus (grinding device 103, cleaning device 104), a warning device is triggered to send an alarm to inform device engineers to fix. The alarm device can be included in the alarm unit 10. The grinding device 103 can send detected data to the alarm unit 10 through the exception monitoring device; if an exception is detected, the warning device of the alarm device sends an alarm (in the situation that the alarm is generated by the grinding device 103), the alarm unit 10 sends an alarm signal to the processing unit 20. The cleaning device 104 can send detected data to the alarm unit 10 through the exception monitoring device; if an exception is detected, the warning device of the alarm device sends an alarm (in the situation that the alarm is generated by the grinding device 104), the alarm unit 10 sends an alarm signal to the processing unit 20.

In some embodiments, organic acid in the organic acid solution is oxalic acid, malonic acid, succinic acid, maleic acid, phthalic acid or amino acid. The organic acid solution has a concentration of 0.01~10 wt % (weight %). The processing unit 20 processes the wafer with organic acid solution in a way that the organic acid solution is sprayed to the wafer by a spray nozzle or in a way that the wafer is positioned in an isolation tank filled with organic acid solution. These two ways will be discussed in the following in detail.

The alarm can be generated in the grinding device 103 or in the cleaning device 104. If the alarm is generated in (by) the grinding device 103, the alarm signal sent from the alarm unit 10 to the processing unit 20 is a first alarm signal; after receiving the first alarm signal, the processing unit 20 processes wafers in the grinding device 103 and the head clean load/unload 102 with organic acid solution. Specifically, the processing unit 20 controls the spray nozzle of the grinding device 103 to spray organic acid solution to wafers on the platen; in addition, the processing unit 20 can control the spray nozzle of the head clean load/unload 102 to spray organic acid solution to wafers in the head clean load/unload 102 (wafers that have been grinded but have not been delivered to the cleaning device 104). In this way, grinding liquid (which includes grinding agent particles) and particles generated by grinding on the surface of the wafer are removed; and the wafer is placed in the environment of organic acid (surface of the wafer tend to be not corroded in such environment), which protects the surface of metal material of the wafer from corrosion. For the cleaning device 104, after being cleaned, the current wafer is delivered to the drying device 106 for a drying treatment and then delivered back to the wafer box. At this point, the grinding device 103 has stopped; there will be no further grinded wafer to be cleaned, therefore, the cleaning device 104 stops.

If the alarm is generated in (by) the cleaning device 104, the alarm signal sent from the alarm unit 10 to the processing unit 20 is a second alarm signal; after receiving the second alarm signal, the processing unit 20 controls the grinding device 103, the cleaning device 104 and the head clean load/unload 102 to process the wafers in the grinding device 103, the cleaning device 104 and the head clean load/unload 102 with organic acid solution. The cleaning device 104 normally uses scrubbing brush to clean a wafer; the scrubbing brush is normally made from PVA; and chemical solutions with PH value of 2 to 12 such as deionized water can be used (sprayed to the wafer) simultaneously to clean the wafer. Specifically, after receiving the second alarm signal, the processing unit 20 processes the wafer in the cleaning device 104 in a manner that the scrubbing brush sprays organic acid solution. In addition, the spray nozzle of the head clean load/unload 102 can be used to spray organic acid solution to the wafer in the head clean load/unload 102 (the wafer which is grinded and has not been delivered to the cleaning device 104). The function of the organic acid solution is the same with the above discussion.

When the processing unit 20 processes the wafer with organic acid solution in a manner of spraying organic acid solution to the wafer, the spray nozzle of the grinding device 103 sprays organic acid solution to the wafer on the platen, the spray nozzle of the head clean load/unload 102 sprays organic acid solution to the wafer in the head clean load/unload 102, or the scrubbing brush of the cleaning device 104 sprays organic acid solution to the wafer in the cleaning device 104. When the processing unit 20 processes the wafer in a manner of spraying, there is provided two spraying stages or steps in the present invention:

The first stage: during the first processing time period after the processing unit 20 receives the alarm signal, the spraying organic acid solution to the wafer is performed continuously, and the spraying of the organic acid solution has a flow rate larger than 1000 ml/min. Since the spraying is performed continuously in the first processing time period, the time for spraying is the same with the first processing time period, which is preferably 1 to 5 minutes in this embodiment. The grinding liquid (contains grinding agent particles) and particles generated by grinding can be removed in a full and fast manner after continuous and high-speed spraying of organic acid solution to the wafer during the initial time period after the alarm signal is received (the first processing time period). The wafer can also be placed in an environment of organic acid, which can effectively prevent the metal material surface of the wafer from corrosion.

The second stage: during the second processing time period that is after the first processing time period and before the alarm is discharged, the spraying organic acid solution to the wafer is performed periodically; the spraying of the organic acid solution has a flow rate larger than 500 ml/min; the interval time is preferably 20%~90% of the first processing time period. The time of spraying by the processing unit 20 to the wafer can be the same each time, which is the difference between the first processing time period and the interval time (i.e. 10%~80% of the first processing time period). The time of spraying by the processing unit 20 to the wafer can also be different each time. To make the control simple, in this embodiment, the time of spraying organic acid solution to the wafer each time are the same. For example, the first processing time period is one minute and the interval time is 90% of the first processing time period; after spraying organic acid solution continuously to the wafer for one minute, the processing unit 20 then waits for 54 seconds (which is 90% of one minute), then sprays organic acid solution to the wafer for 6 seconds (1 minute minus 54 seconds), then waits for another 54 seconds, and then sprays again for 6 seconds . . . until the alarm is discharged by device engineers. The above procedure can also be like: after spraying organic acid solution continuously to the wafer for one minute, the processing unit 20 continues to spray for 6 seconds, then waits for 54 seconds, and then sprays for 6 seconds, and then waits for another 54 seconds . . . until the alarm is discharged by device engineers. There may be such situations as follows in some embodiments: if the alarm is discharged within the first processing time period, there will be no second processing time period; or if the second processing time period is very short, and there is no interval. In this embodiment, since the grinding liquid (containing grinding agent particles) and particles generated by grinding on the surface of the wafer have been removed substantially and the wafer has been placed in the environment of organic acid in the first stage of the spraying, the spraying of the second stage lasts for a very shot time, and the flow rate of the second stage spraying is much smaller than that of the first stage spraying. The second stage spraying keeps the wafer in the environment of organic acid solution, and further removes the grinding agent particles and particles generated by grinding on the surface of the wafer, which avoids the corrosion of the metal material surface of the wafer and saves the organic acid solution (down cost).

After receiving the second alarm signal, the processing unit 20 processing the wafer in the grinding device 103 with organic acid solution includes: placing the wafer that has been grinded by the grinding device 103 into an isolation tank 105 filled with organic acid solution. Specifically, after the wafer that has been grinded by the grinding device 103 is placed in the head clean load/unload 102, the wafer is placed in the isolation tank 105 filled with organic acid solution by the transmission. In this way, the wafer can be placed in an organic acid environment, which avoids corrosion of the surface of metal material of the wafer. After the alarm is discharged, the polishing apparatus starts to work again, the wafer in the isolation tank 105 will be delivered to the cleaning device 104 for cleaning, and the organic acid solution on the surface of the wafer will be removed by deionized water. In conventional technologies, when the alarm is generated by the grinding device of the polishing apparatus, the wafer that has been grinded by the grinding device will be positioned in an isolation tank filled with deionized water; however, the wafer is in the environment of deionized water, which causes the corrosion of the surface of metal materials. The isolation tank 105 which is filled with organic acid solution solves the problem in this embodiment of the present invention.

Figure 2:
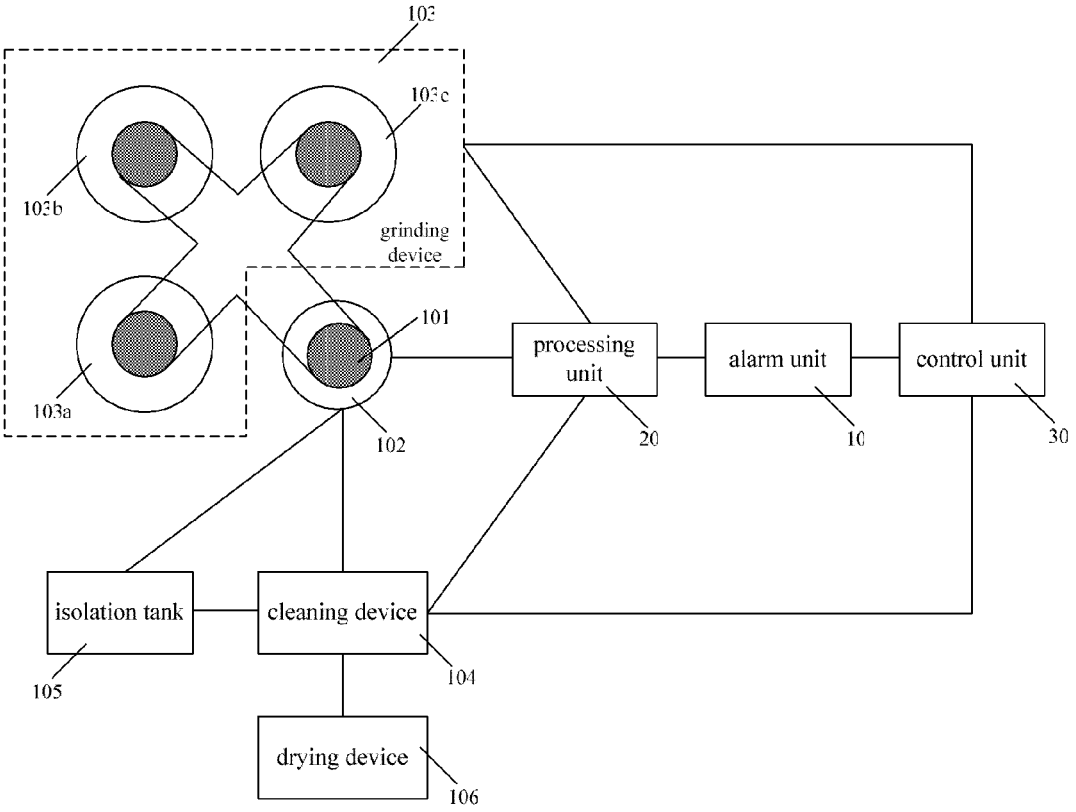
FIG. 2 is a schematic view of a polishing apparatus in another embodiment of the present invention.

In conventional technologies, the alarm device can be included in a control unit (such as a computer which controls the polishing apparatus). The control unit controls devices of the polishing apparatus to stop working according to the detected data from the exception monitoring device, and sends an alarm through the warning device. Therefore, in other embodiments, the control unit can be used to determine which device polishing apparatus generates the exception. FIG. 2 is a schematic view of a polishing apparatus in another embodiment of the present invention. Referring to FIG. 2, the difference between this embodiment and the previous embodiment is that there is a control unit 30 connected with the alarm unit 10' in the polishing apparatus. The alarm device is placed in the control unit 30; the grinding device 103 sends detected data to the control unit 30 through the exception monitoring device; if an exception is detected, the warning device will send an alarm (in the situation that the alarm is generated by the grinding device 103) and control the alarm unit 10' to send an alarm signal to the processing unit 20. The cleaning device 104 sends the detected data to the control unit 30 through the exception monitoring device; if an exception is detected, the warning device will send an alarm (in the situation that the alarm is generated by the cleaning device 104) and control the alarm unit 10' to send an alarm signal to the processing unit 20. In addition, the control unit 30 can receive detected data form other devices (such as the head clean load/unload 102) in the polishing apparatus and control the alarm unit 10' to send corresponding alarm signals to the processing unit 20 (FIG. 2 does not show the connections). The other details of this embodiment can refer to that of the previous embodiment.

Figure 3:
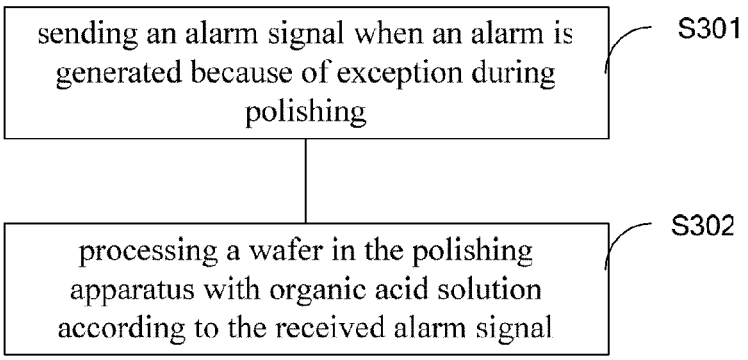
FIG. 3 is a flow diagram of an exception handling method of polishing apparatus in still another embodiment of the present invention.

Based on the polishing apparatus, there is also provided an exception handling method of polishing apparatus in the present invention. FIG. 3 is a flow diagram of an exception handling method of polishing apparatus in still another embodiment of the present invention. Referring to FIG. 3, the exception handling method of polishing apparatus in this embodiment includes:

S301, sending an alarm signal when an alarm is generated because of an exception during polishing; and S302, processing a wafer in the polishing apparatus with organic acid solution according to the received alarm signal.

The details of this embodiment can refer to that of the previous embodiment of the polishing apparatus.

In comparison with the conventional technologies, the present invention has the following advantages:

Where there is an alarm generated because of an exception during polishing of a wafer in a polishing apparatus, the alarm unit sends an alarm signal to the processing unit, and the processing unit processes the wafer in the polishing apparatus with organic acid solution, which prevents the surface of the wafer from contacting grinding liquid or cleaning liquid for a long time, avoids the corrosion of the surface (which causes device failure) and improves the quality of wafers.

The two stages of the spraying of the organic acid solution can remove types of particles on the surface of the wafer in a full and fast manner, which prevents the metal surface from corrosion and decreases the cost at the same time.

Although the present invention has been illustrated and described with reference to the preferred embodiments of the present invention, those ordinary skilled in the art shall appreciate that various modifications in form and detail may be made without departing from the spirit and scope of the invention.

What is claimed is:

1. An exception handling method, comprising:

monitoring a working status of both a grinding device and a cleaning device in a polishing apparatus to provide detected data, wherein the grinding device includes an exception monitoring device placed in the grinding device, and the cleaning device includes an exception monitoring device placed in the cleaning device;

sending back detected data from the exception monitoring device in the grinding device or from the exception monitoring device in the cleaning device;

determining, by a polishing apparatus control computer, which device in the polishing apparatus generates an exception; and if an exception is detected from the grinding device, the exception including an exception of a pressure or a rotation speed of a grinding head, sending a first alarm signal from the alarm unit to a processing unit in the polishing apparatus;

in response to the first alarm signal, controlling, by the processing unit, a spray nozzle of the grinding device to spray an organic acid solution to a wafer on a platen; and after the wafer has been grinded and before the wafer has been delivered to the cleaning device, controlling, by the processing unit, a spray nozzle of the head clean load/unload to spray the organic acid solution to the wafer in the head clean load/unload; or if the exception is detected from the cleaning device;

sending a second alarm signal from the alarm unit to the processing unit in the polishing apparatus; and in response to the second alarm signal, controlling, by the processing unit, the grinding device, the cleaning device, and the head clean load/unload to process: the wafer in the grinding device, and the wafer in the head clean load/unload after grinding, and then the wafer in the cleaning device, with the organic acid solution.

2. The exception handling method of polishing apparatus of claim 1, further including:

placing the wafer, that has been grinded by the grinding device, into an isolation tank filled with the organic acid solution to avoid corrosion of a surface of a metal material of the wafer until the polishing apparatus is restarted, and delivering the wafer from the isolation tank to the cleaning device for cleaning.

3. The exception handling method of polishing apparatus of claim 1, wherein the organic acid solution is sprayed to the wafer continuously during a first processing time period after the alarm signal is received.

4. The exception handling method of polishing apparatus of claim 3, wherein the first processing time period is 1 to 5 minutes.

5. The exception handling method of polishing apparatus of claim 3, wherein the organic acid solution sprayed to the wafer has a flow rate larger than 1000 ml/min.

6. The exception handling method of polishing apparatus of claim 3, wherein the organic acid solution is sprayed to the wafer periodically during a second processing time period which is after the first processing time period.

7. The exception handling method of polishing apparatus of claim 6, wherein for each time when the organic acid solution is sprayed to the wafer, time for spraying the organic acid solution plus interval time is equal to the first processing time period, and the interval time is 20%-90% of the first processing time period.

8. The exception handling method of polishing apparatus of claim 6, wherein the organic acid solution sprayed to the wafer has a flow rate larger than 500 ml/min.

9. The exception handling method of polishing apparatus of claim 1, wherein the organic acid solution includes an oxalic acid, malonic acid, succinic acid, maleic acid, phthalic acid or amino acid.

10. The exception handling method of polishing apparatus of claim 1, wherein the organic acid solution has a concentration of 0.01-10 wt %.

11. The exception handling method of the polishing apparatus of claim 1, wherein one or more of the alarm unit and the processing unit include a software control system of the polishing apparatus; or include a hardware device controlled by a software control system of the polishing apparatus.

12. The exception handling method of the polishing apparatus of claim 1, wherein monitoring the working status of the grinding device includes a real-time detection of the pressure and the rotation speed of the grinding head of the grinding device.

* * * * *